US007415910B2

(12) United States Patent
Arai

(10) Patent No.: US 7,415,910 B2
(45) Date of Patent: Aug. 26, 2008

(54) CONTINUOUS SCREW TIGHTENING MACHINE

(75) Inventor: Kunihiro Arai, Utsunomiya (JP)

(73) Assignee: Muro Corporation, Tokyo (JP)

( * ) Notice: Subject to any disclaimer, the term of this patent is extended or adjusted under 35 U.S.C. 154(b) by 0 days.

(21) Appl. No.: 11/223,931

(22) Filed: Sep. 13, 2005

(65) Prior Publication Data

US 2006/0053978 A1 Mar. 16, 2006

(30) Foreign Application Priority Data

Sep. 16, 2004 (JP) ..... 2004-270061

(51) Int. Cl.
*B25B 23/04* (2006.01)

(52) U.S. Cl. ..... 81/57.37; 81/433; 81/434; 81/435

(58) Field of Classification Search ..... 81/52–57.5, 81/433–435, 180.1, 185.1
See application file for complete search history.

(56) References Cited

U.S. PATENT DOCUMENTS

| | | | | | |
|---|---|---|---|---|---|
| 2,689,589 | A * | 9/1954 | Allen et al. | ..... | 81/57.37 |
| 2,770,269 | A * | 11/1956 | Austin | ..... | 81/433 |
| 3,021,882 | A * | 2/1962 | Knoll et al. | ..... | 81/432 |
| 3,212,316 | A * | 10/1965 | Smith et al. | ..... | 72/412 |
| 3,730,027 | A * | 5/1973 | Rohn | ..... | 81/462 |
| 3,960,191 | A | 6/1976 | Murray | | |
| 4,375,119 | A * | 3/1983 | DeCaro | ..... | 29/240 |
| 4,517,863 | A * | 5/1985 | Ishikawa | ..... | 81/434 |
| 4,674,367 | A * | 6/1987 | Aab et al. | ..... | 81/57.37 |
| 4,821,877 | A * | 4/1989 | Aab et al. | ..... | 206/338 |
| 5,144,870 | A * | 9/1992 | Nick | ..... | 81/434 |
| 6,109,144 | A * | 8/2000 | Muro | ..... | 81/434 |
| 6,109,146 | A * | 8/2000 | Muro | ..... | 81/434 |
| 6,296,064 | B1 * | 10/2001 | Janusz et al. | ..... | 173/30 |
| 6,862,963 | B2 * | 3/2005 | Habermehl et al. | ..... | 81/434 |

FOREIGN PATENT DOCUMENTS

| | | |
|---|---|---|
| JP | 52-1699 | 1/1977 |
| JP | 9-136269 | 5/1997 |

* cited by examiner

*Primary Examiner*—Joseph J. Hail, III
*Assistant Examiner*—Robert Scruggs
(74) *Attorney, Agent, or Firm*—Wenderoth, Lind & Ponack, L.L.P.

(57) ABSTRACT

A continuous screw tightening machine including a driving machine (4) equipped with a grip handle (2); a tightening machine main body (3) with which a bit (7) for screw tightening is removably connected to the driving machine (4) through a reduction gear and a clutch; and a screw feed mechanism through which the bit (7) is rotatably inserted and which sequentially feeds a screw to the position where a tightening operation is to be carried out by the bit 7. The screw tightening machine also includes a screw feed mechanism main body (6) which is connected to the front of the tightening machine main body (3) so as to be slidable in the longitudinal direction, a screw supply mechanism (110) which continuously supplies a number of single-part screws in sequence to the screw feed mechanism under the force of gravity, and a tip block (12) which is connected to the screw feed mechanism main body, providing a surface to be contacted with an object.

15 Claims, 14 Drawing Sheets

FIG.19(a) Stroke is 0

FIG.19(b) Stroke is 20

FIG.19(c) Stroke is 30

FIG.19(d) Stroke is 44

FIG.19(e) Stroke is 76

FIG.19(f) Stroke is 30

FIG.19(g) Stroke is 8

FIG.19(h) Stroke is 0

CONTINUOUS SCREW TIGHTENING MACHINE

BACKGROUND OF THE INVENTION

1. Field of the Invention

The present invention relates to a continuous screw tightening machine which, in order to fix a plate material, such as a wooden plate, a metallic plate or a gypsum plate, on the floor or the like, continuously tightens screws without the need for using a conventional screw gang element containing a number of screws arranged at prescribed intervals in a row by means of a belt-like member.

2. Description of the Related Art

Conventionally, in order to screw-fix a plate material, such as a wooden plate, a metallic plate or a gypsum plate, on the floor or other object, a continuous screw tightening machine which can continuously tighten screws has been proposed.

This type of continuous screw tightening machine is exemplified by a continuous screw tightening machine with which a screw gang element containing a number of screws arranged at prescribed intervals in a row by means of a belt-like member is loaded in the screw tightening machine main body for tightening a screw while feeding another screw, but before the advent of the continuous screw tightening machine, the single-shot screw tightening machine with which a single-part screw is charged into the screw tightening machine main body one at a time and screwed-in into the object one by one had been used.

The patent document 1 discloses a continuous screw tightening machine with which the screw gang element is loaded in the screw tightening machine main body for tightening a screw while feeding another screw. With this machine, a driving machine is incorporated in the tightening machine main body on which a grip handle is formed; to the front of the tightening machine main body is mounted a screw feed mechanism main body through a pair of guide poles such that the screw feed mechanism main body is capable of being slid in the longitudinal direction; between the pair of guide poles is parallel disposed a bit for tightening the screw, and this bit is removably connected to a clutch such that it is rotation-driven through a rotating spindle, a reduction gear, and the clutch; and to the screw feed mechanism main body is mounted a magazine accommodating a screw gang element containing screws arranged in a row by means of a belt-like member and then rolled. Although the patent document discloses a continuous screw tightening machine with which a magazine accommodating said screw gang element is mounted, a continuous screw tightening machine with which the magazine is not used, but only said screw gang element is used is also available.

However, with the continuous screw tightening machine as disclosed in the patent document 1, the screw gang element is employed, and to use this continuous screw tightening machine, the screw gang element containing a number of screws arranged by means of a belt-like member must be previously formed; the formation of the screw gang element itself is complicated and thus the expense for it is high; and due to the amount of such expense, the operating cost of the continuous screw tightening machine has been high. The continuous screw tightening machine as disclosed in the patent document 1 is a machine of the type which must use the screw gang element, regardless of whether the magazine is used or not.

The patent document 2 discloses a portable fastening bit power driving tool which is of one-by-one tightening type. With this tool, one portion of a main body formed in the shape of a Y comprises an upper tube, a driving spindle, and a driving tool. The other portion comprises a supply tube which supplies a single-part screw. The upper tube and the supply tube are connected to the lower tube. Also, the upper tube and the driving spindle are configured such that they are capable of being reciprocated with respect to the lower tube. An escape apparatus, which is synchronized with the motion of the upper tube and the driving spindle, is provided, and by the motion of the upper tube, the escape apparatus is operated to supply a fastening bit to the lower tube during the return stroke of the driving tool.

However, the portable fastening bit power driving tool as disclosed in the patent document 2 is constructed such that the screw is charged one by one into the supply tube, thus it is, of course, impossible to carry out a continuous screw tightening operation. When a plurality of screws are accidentally charged into the supply tube, blocking is caused; and if a screw is charged in a reverse orientation, there will arise the need for taking it out. Other disadvantages are involved, and thus, every time one cycle of a tightening operation is completed, the subsequent screw must be confirmed for its orientation before being charged into the supply tube. Thus, an extremely time-consuming operation is required, and the operation efficiency is extremely low.

Patent Document 1

Patent Publication No. JP/P09-136269A/1997

Patent Document 2

Patent Publication No. JP/P52-1699A/1977

SUMMARY OF THE INVENTION

1. Problem to Solved

No continuous screw tightening machine is available which precisely feeds single-part screws without the need for use of said conventional screw gang element, and can continuously and efficiently screw-in screws into a plate material or other object.

2. Means to Solve the Problem

The continuous screw tightening machine according to the present invention provides the most important feature of that it is a continuous screw tightening machine, wherein a driving machine equipped with a grip handle is mounted; to the driving machine, a bit for screw tightening is removably connected through a reduction gear and a clutch to configure a tightening machine main body; to the front of said tightening machine main body is mounted a screw feed mechanism main body such that the screw feed mechanism main body is capable of being slid in the longitudinal direction; said bit is rotatably inserted into the inside of the screw feed mechanism main body; in said screw feed mechanism main body is configured a screw feed mechanism which is synchronized with the sliding in the longitudinal direction of the tightening machine main body involved in the screw tightening operation by the bit to sequentially feed a screw to the position where tightening operation is carried out by the bit; to the screw feed mechanism in said screw feed mechanism main body is connected a screw supply mechanism which continuously supplies a number of single-part screws in sequence under the force of gravity; and a tip block which is connected to said screw feed mechanism main body, providing a surface to be contacted with an object, is configured such that the tip block is capable of being fixed in a desired position in the longitudinal direction with respect to the screw feed mechanism main body.

3. Effects of the Invention

According to the present invention, the following effects are obtained.

According to the invention, by applying the contact surface of the tip block of the continuous screw tightening machine to the object, and sliding forward the tightening machine main body to which the bit is connected to the driving machine through the reduction gear and clutch, the screw in the tightening operation position in the screw feed mechanism main body is capable of being efficiently screwed-in into the object, such as a plate material. Because the screw supply mechanism continuously supplies a number of single-part screws in sequence to the screw feed mechanism main body under the force of gravity, and the screw feed mechanism in the screw feed mechanism main body sequentially feeds a single-part screw from the screw supply mechanism to the tightening operation position in synchronism with the sliding in the longitudinal direction of the tightening machine main body, single-part screws are capable of being continuously and efficiently screwed-in into the object.

According to the invention, the same function as described is capable of being provided, and because a stand for erection is mounted to the tip block, single-part screws are capable of being continuously screwed-in into an object with good operability, the continuous screw tightening machine being erected on the object surface.

According to the invention, by applying the contact surface of the tip block to the object with the continuous screw tightening machine being erected on the object surface in the same way as that in the invention, and sliding forward the tightening machine main body to which the bit is connected to the driving machine through the reduction gear and clutch, the screw in the tightening operation position in the screw feed mechanism main body is capable of being efficiently screwed into the object, such as a plate material.

In this case, the screw supply mechanism continuously and sequentially supplies a number of single-part screws charged from a screw charge opening in the horizontal orientation while supporting the head and changing the orientation of the screws from horizontal to vertical during transportation under the force of gravity to the screw feed mechanism main body; and in response to the displacement of said pressing element by the sliding of the tightening machine main body in the backward direction, the screw feed mechanism in the screw feed mechanism main body sequentially feeds a single-piece screw to the position for tightening operation by said bit, while performing positional regulation of the following single-piece screw to position and hold the head and body of the screw, and in response to the displacement of said pressing element by the sliding of the tightening machine main body in the forward direction in tightening operation, releases positioning and holding of the head and body of the screw, thus single-part screws are capable of being efficiently screwed-in into the object while the position of the single-part screw with respect to the object being stably maintained.

In addition, the tightening machine main body is equipped with a screwing-in depth adjusting mechanism for adjusting the screwing-in depth for the bit, and a pressing element which is disposed with a fixed spacing from the bit is protruded in the same direction as the bit, thus even when a plurality of types of screw that are different in length dimension are to be used, the screwing-in depth adjusting mechanism allows continuous and efficient screw tightening to be carried out under an optimum condition, accommodating the difference in length dimension.

The present invention has achieved the purpose of carrying out precise feeding of single-part screws without the need for use of said conventional screw gang element, and allowing continuous and efficient screwing-in of screws into a plate material or other object, by configuring a continuous screw tightening machine, wherein a driving machine equipped with a grip handle is mounted; to the driving machine, a bit for screw tightening is removably connected through a reduction gear and a clutch to configure a tightening machine main body; to the front of such tightening machine main body is mounted a screw feed mechanism main body such that the screw feed mechanism main body is capable of being slid in the longitudinal direction; said bit is rotatably inserted into the inside of the screw feed mechanism main body; in the screw feed mechanism main body is configured a screw feed mechanism which is synchronized with the sliding in the longitudinal direction of the tightening machine main body involved in the screw tightening operation by the bit to sequentially feed a screw to the position where tightening operation is carried out by the bit; to the screw feed mechanism in the screw feed mechanism main body is connected a screw supply mechanism which continuously supplies a number of single-part screws in sequence under the force of gravity; a tip block which is connected to said screw feed mechanism main body, providing a surface to be contacted with an object, is configured such that the tip block is capable of being fixed in a desired position in the longitudinal direction with respect to the screw feed mechanism main body; and to the screw feed mechanism main body, a stand for erecting is mounted through the tip block which is capable of being movably fixed in the longitudinal direction.

DETAILED DESCRIPTION OF THE INVENTION

Hereinbelow, an embodiment of the continuous screw tightening machine according to the present invention will be described with reference to the drawings.

Figure 1:
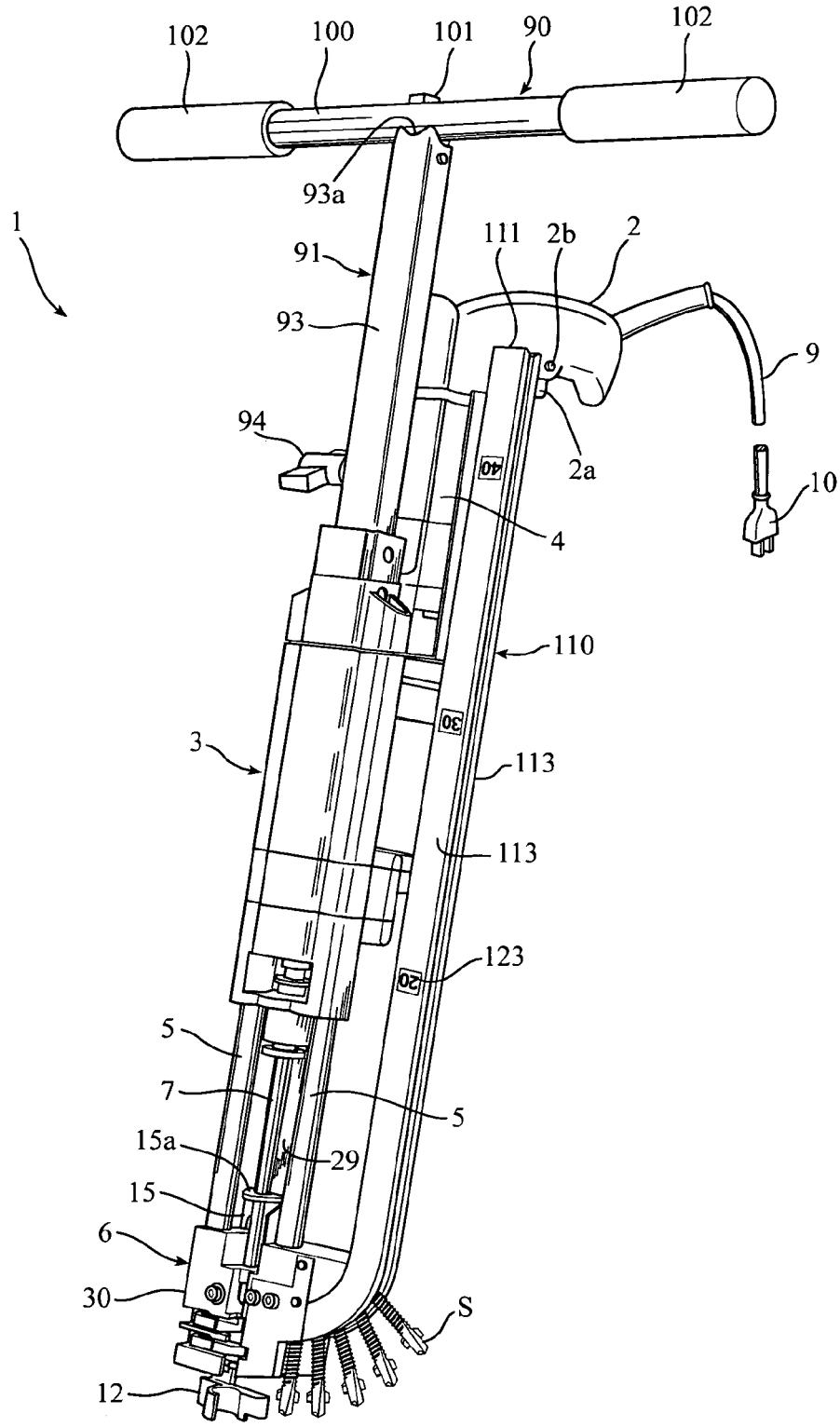
FIG. 1 is a perspective side view of a continuous screw tightening machine according to the present embodiment.

FIG. 1 shows the appearance of a continuous screw tightening machine 1 according to the present embodiment.

With this continuous screw tightening machine 1, a driving machine 4 equipped with a grip handle 2 having a trigger switch 2*a* is mounted to a tightening machine main body 3; to the front of the tightening machine main body 3 is mounted a screw feed mechanism main body 6 through a pair of guide poles 5, 5 such that the screw feed mechanism main body is capable of being slid in the longitudinal direction; and further, to the screw feed mechanism main body 6 is mounted a tip block 12 which is to be contacted with an object 150 (see FIG. 2), such as a plate material.

Figure 4:
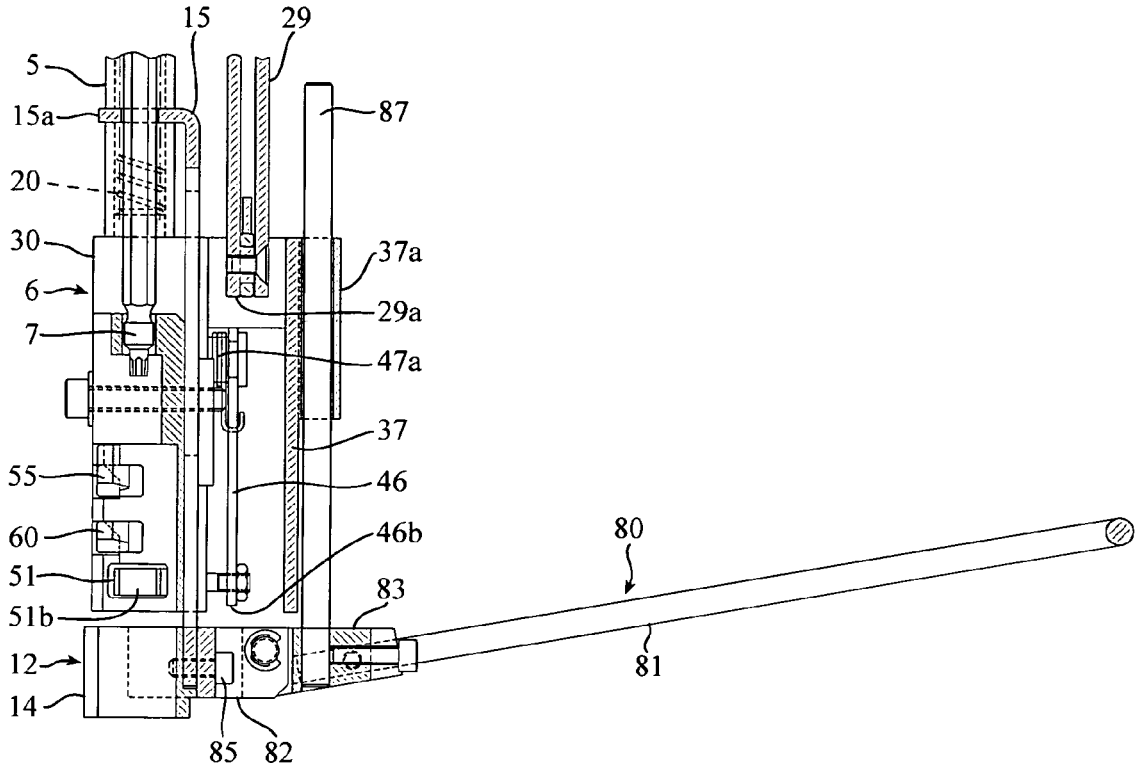
FIG. 4 is a diagrammatic sectional view of the screw feed mechanism main body and stand of a continuous screw tightening machine according to the present embodiment.

Further, to the tip block 12 is mounted a stand 80 for causing the continuous screw tightening machine 1 itself to be erected, as shown in FIG. 4. The stand 80 may be adapted such that it is removably mounted to the tip block 12. Further, with continuous screw tightening machine 1, a holding handle 90 is removably mounted to the back of the tightening machine main body 3, and a screw supply mechanism 110 for automatically supplying screws S is mounted along the tightening machine main body 3.

In FIG. 1, a power supply cable is indicated by 9, and an attachment plug to a commercial power supply is indicated by 10.

Between the pair of guide poles 5, 5 is a bit 7 disposed in parallel to the guide poles for tightening the screw S. The bit 7 is connected to the driving machine 4 through a rotating spindle 21*a*, a reduction gear 8, and a clutch 21*b*, and is removably fixed to a chuck 22 at the end of the clutch 21*b* with a groove 7*b* of the bit 7 such that the bit 7 is capable of being driven in rotation.

The bit 7 is a member corresponding to a screwdriver as a general tool, comprising a shaft which has a sectional geometry in the shape of a hexagon. At both ends of this bit 7, an engaging convex 7*a* which is engaged in the engaging recess of the screw S, such as a cross recess, is formed, and in the vicinity of this engaging convex 7*a*, an annular groove 7*b* is annularly formed such that it is engaged with the chuck 22 which is disposed at the bottom of the clutch 21*b*.

The bit 7 is capable of being used with the upper and lower ends being reversed, depending upon the degree of wear of the engaging convex 7*a* at the respective ends, and is replaced with a new bit 7 when the engaging convexes 7*a*, 7*a* at both ends have worn.

The screwing-in depth for the bit 7 is adjusted through the turning operation of an adjuster ring 23, which serves as a screwing-in depth adjusting mechanism and is provided in the central portion on the front side of the tightening machine main body 3. This adjuster ring 23 is cylindrically formed such that the bit 7 mounted to the chuck 22 is capable of being inserted through it in the front portion of the tightening machine main body 3.

This adjuster ring 23 is threadably (screwably) mounted to the tightening machine main body 3, and by turning to adjust it, the amount of protrusion of the bit 7 from the tip block 12 is capable of being changed to suit a desired screwing-in depth for the screw S.

Turning this adjuster ring 23 in a clockwise direction in the drawing, for example, will increase the screwing-in depth, while turning it counterclockwise will decrease the screwing-in depth. Therefore, if the amount of protrusion set with the adjuster ring 23 is increased, the screwing-in distance (stroke) for the bit 7 will have to be relatively shortened. Contrarily, if the amount of protrusion is decreased with the adjuster ring 23, the screwing-in distance for the bit 7 will have to be relatively extended.

In both side portions of the screw feed mechanism main body 6, holes 31, 31 for receiving the two guide poles 5, 5 are provided so as to be disposed in parallel. In the inside of the holes 31, 31 for receiving the guide poles 5, 5 are incorporated elastic members 20, 20, such as a coil spring. This elastic member 20 is provided to always energize the screw feed mechanism main body 6 in the direction of pushing it out under the elastic force.

The tightening machine main body 3 is equipped with a pressing element 29 which is disposed in the same direction as the bit 7, the end portion 29*a* thereof facing the screw feed mechanism main body 6.

The screw feed mechanism main body 6 is provided with a screw feed mechanism 24 (see FIG. 9) which is synchronized with the screw tightening operation of the tightening machine main body 3 to feed the screw S to the position where a tightening operation is carried out by the bit 7. Hereinbelow, this screw feed mechanism 24 of the screw feed mechanism main body 6 will be described in detail with reference to FIG. 4 to FIG. 12. The screw feed mechanism 24 of the screw feed mechanism main body 6 comprises a feeder block 30 which is approximately a rectangular parallelepiped, and is provided with the holes 31, 31 for receiving the guide poles 5, 5 in the top of both side portions thereof, and a through-hole 32 in the central portion thereof through which the bit 7 is capable of being passed. To the back of this feeder block 30, a feed lever 41 and a support lever 46, which each functions as a plate cam that turns in response to the displacement in the longitudinal direction of the end portion 29*a* of the pressing element 29, are turnably mounted by using mounting screws 42, 47, respectively.

Figure 7:
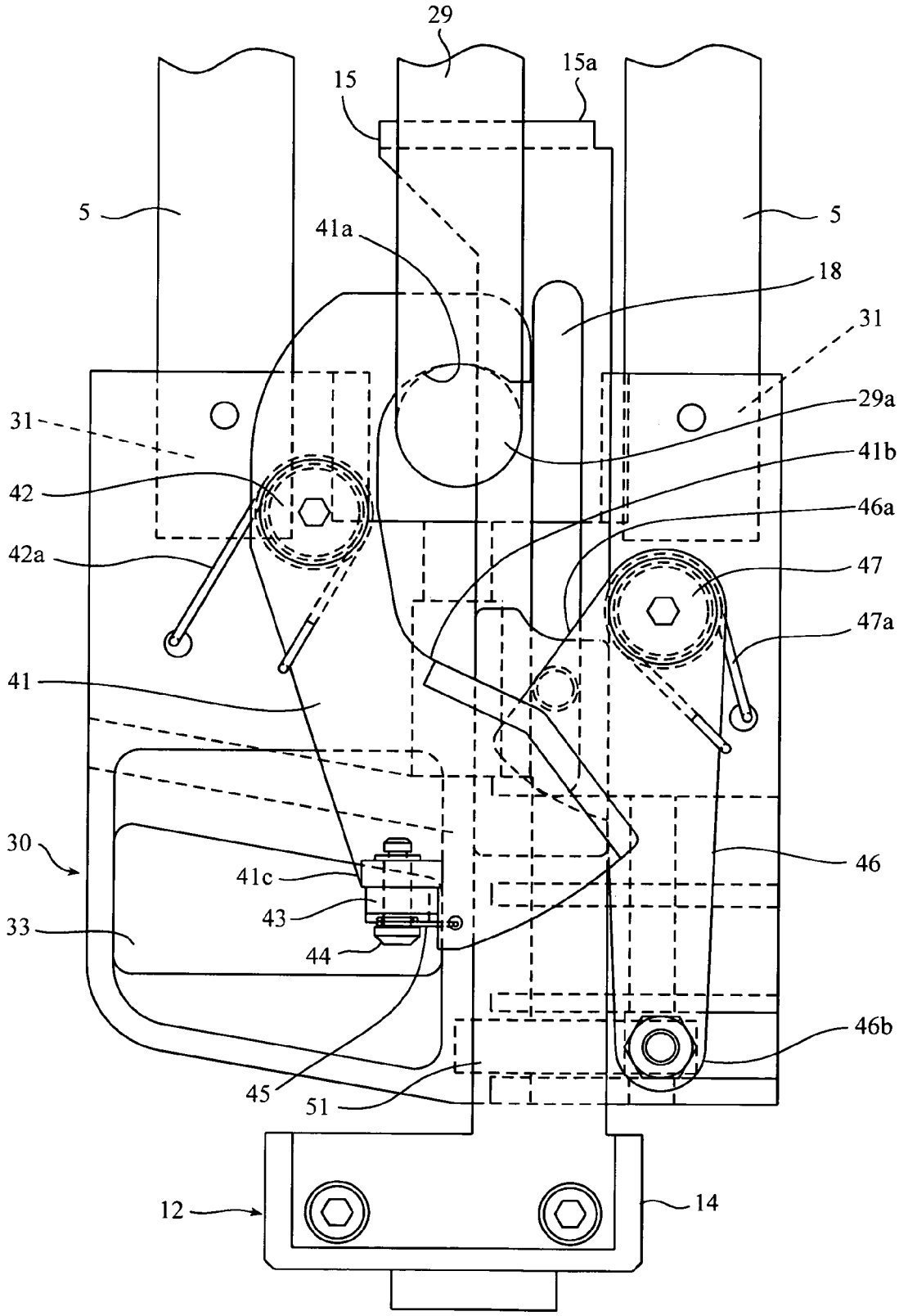
FIG. 7 is an enlarged rear view of the screw feed mechanism main body and tip block of a continuous screw tightening machine according to the present embodiment.
Figure 8:
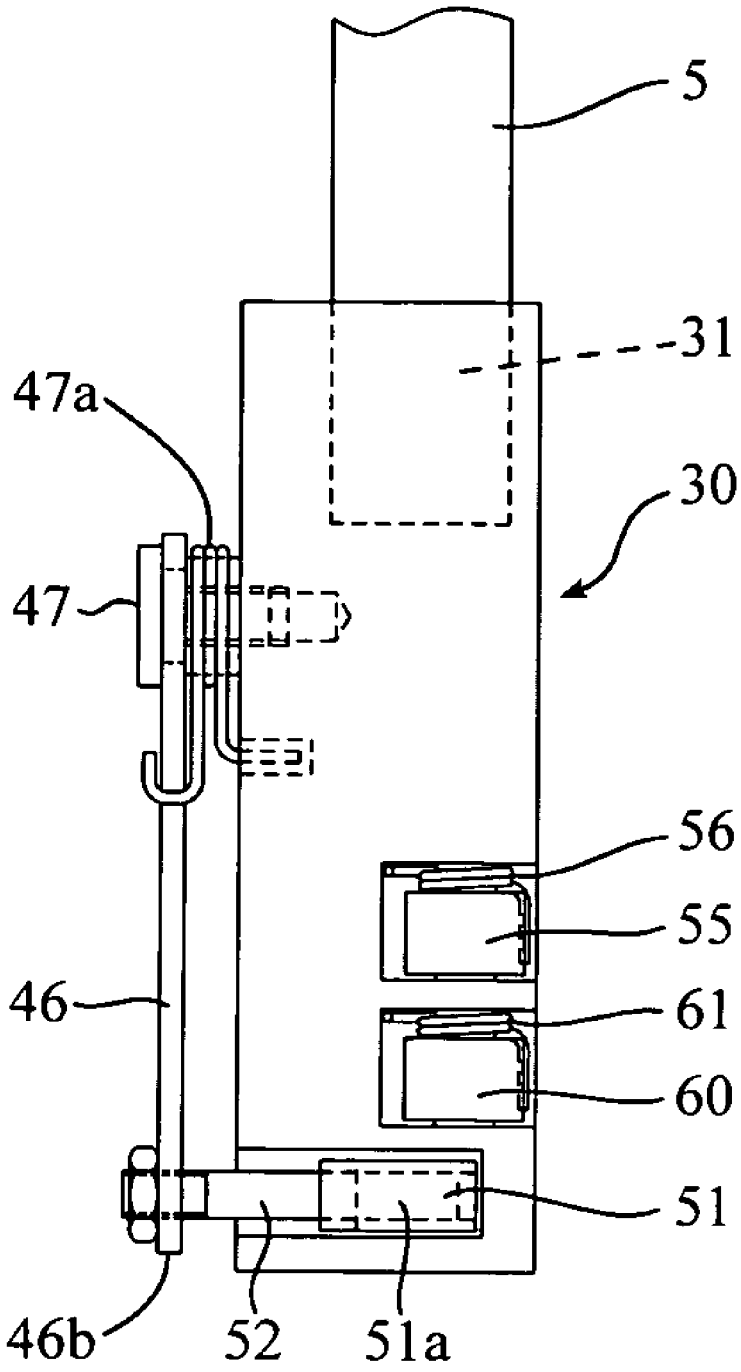
FIG. 8 is a side view of the screw feed mechanism main body of a continuous screw tightening machine according to the present embodiment.

The feed lever 41 is energized in a counterclockwise direction in FIG. 7 by an energizing spring 42*a* which is wound around the body of the mounting screw 42, one end being engaged with the outer edge of this feed lever 41, and the other end being engaged with a hole provided in the feeder block 30.

The support lever 46 is energized in a clockwise direction in FIG. 7 by an energizing spring 47*a* which is wound around the body of the mounting screw 47, one end being engaged with the outer edge of this support lever 46, and the other end being engaged with a hole provided in the feeder block 30.

Figure 6:
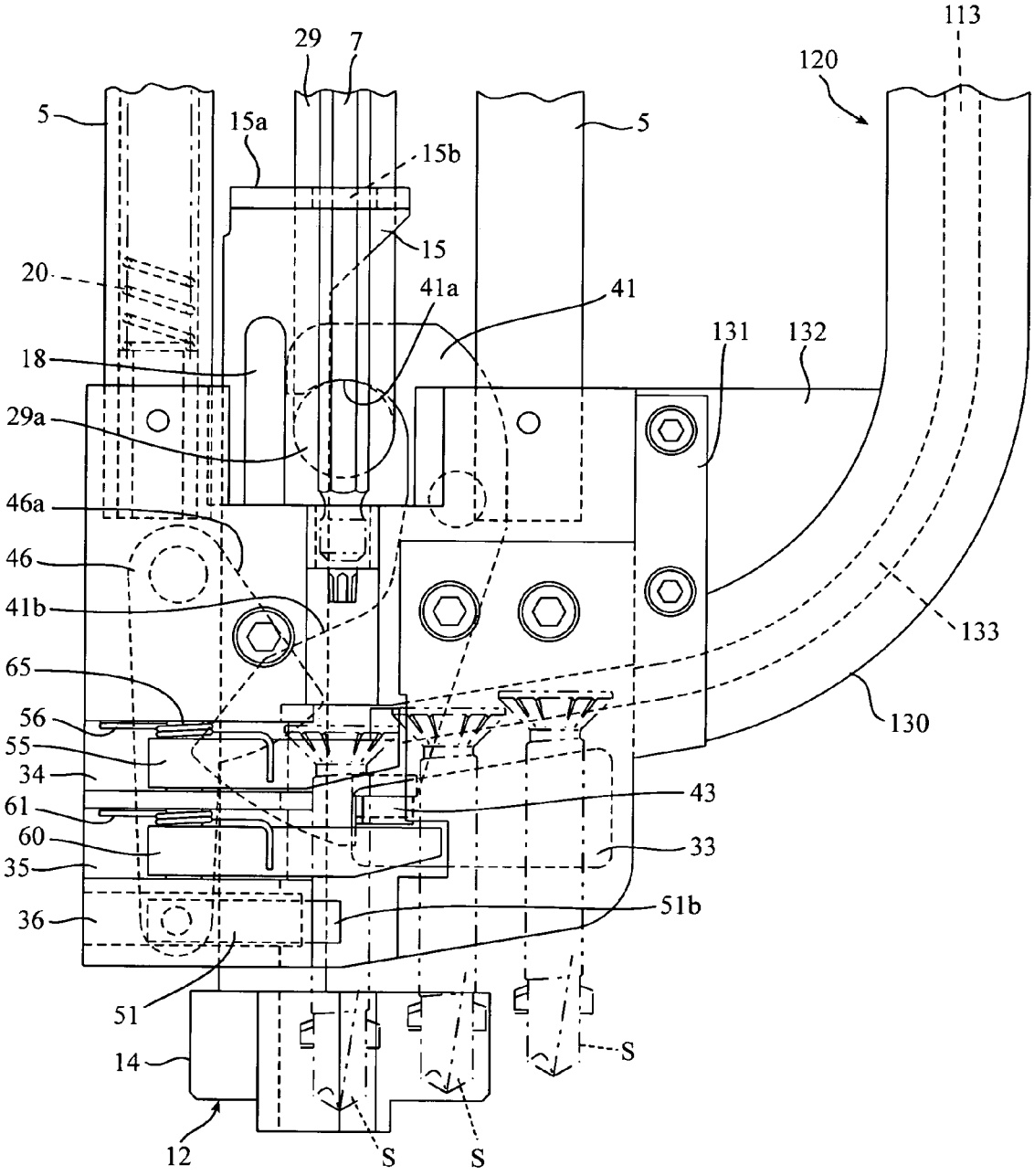
FIG. 6 is an enlarged view illustrating a portion of the screw feed mechanism main body, tip block, and screw supply mechanism of a continuous screw tightening machine according to the present embodiment.
Figure 9:
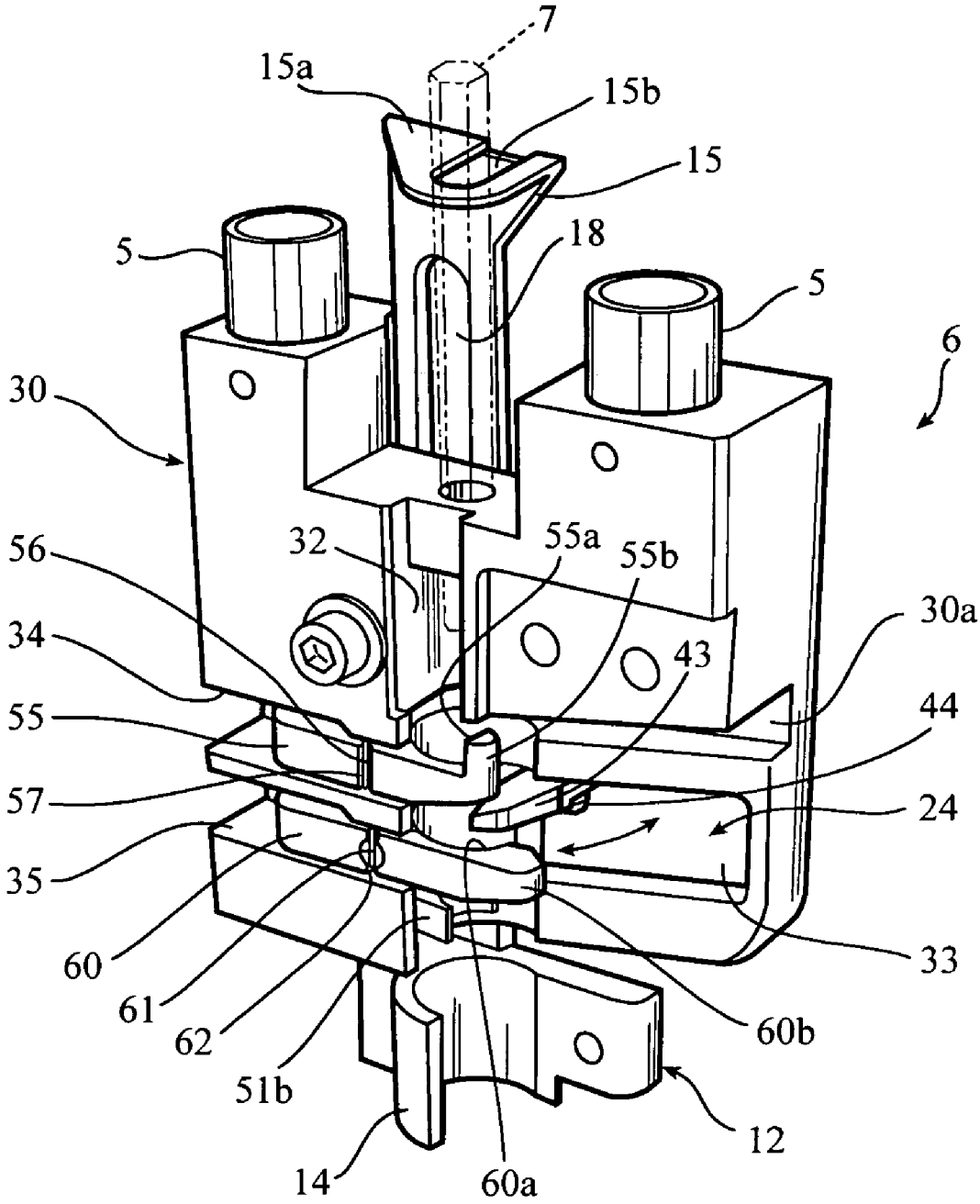
FIG. 9 is a perspective side view of the screw feed mechanism main body and tip block of a continuous screw tightening machine according to the present embodiment.
Figure 10:
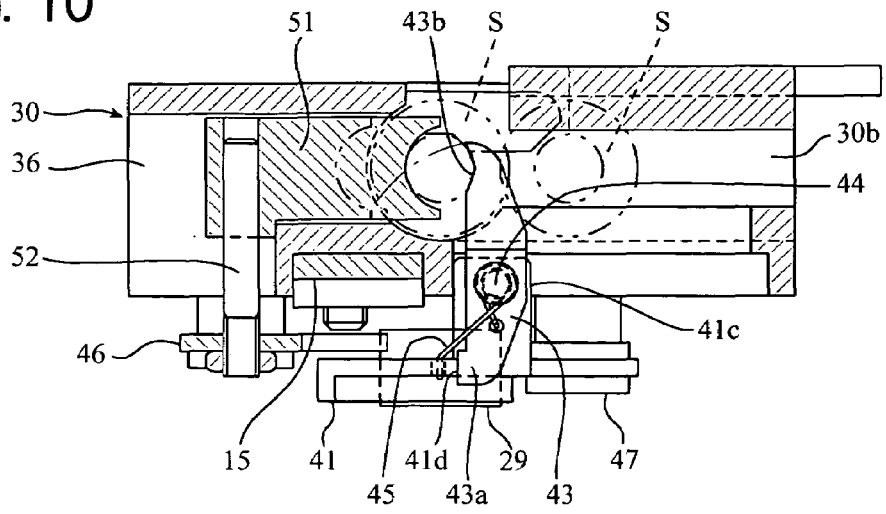
FIG. 10 is a diagrammatic view of the feed lever and feed latch of a continuous screw tightening machine according to the present embodiment.

As shown in FIG. 6 and FIG. 9, the feeder block 30 is provided with a latch hole 33 to secure the displacement space for a feed latch 43 which is mounted to the feed lever 41 in the front right side portion thereof.

In addition, as shown in FIG. 6 to FIG. 9, the feeder block 30 is provided with a recess 34 for a grip finger 55 to hold the head of the screw S, a recess 35 for a grip holder 60 to hold the head of the screw S, and a relief hole 36 for a support block 51 which is displaced through a pin 52 in accordance with the turning motion of the support lever 46, in this order from top to bottom in the front left side portion thereof, i.e., on the opposite side of the latch hole 33. The recess 34, the recess 35, and the relief hole 36 are provided in the direction orthogonal to the axis of the through-hole 32.

With the feed lever 41, an arc-shaped contoured portion 41*a* which is engaged with the end portion 29*a* of the pressing element 29 is formed in the portion above the mounting screw 42, while a lower contoured portion 41*b* is formed in the portion under the mounting screw 42 by connecting a curved outline portion with a straight outline portion.

The feed latch 43 is turnably fixed to the folded outline portion 41*c* provided in the lower end portion on the opposite side of the lower contoured portion 41*b* by using a pin 44, one end 43*a* of this feed latch 43 is always energized by use of a spring 45 such that it is contacted with the lower end receiving portion 41*d* of the feed lever 41.

The engaging concave 43*b* for the body of the screw S that is provided at the other end of the feed latch 43 is disposed to face the inside of the latch hole 33, and by the turning motion of the feed lever 41 in accordance with the displacement of the pressing element 29, the engaging concave 43*b* of the feed latch 43 is reciprocation-displaced in the latch hole 33 as shown with arrows in FIG. 9 such that it is separated from or approached to the screw-S tightening operation position in the through-hole 32.

The support lever 46 is disposed so as to face the displacement region for the end portion 29*a* of the pressing element 29, being provided with the contoured portion 46*a* which functions as a cam, being contacted with the end portion 29*a*. The lower end portion 46*b* of this support lever 46 is disposed so as to face the vicinity of the relief hole 36, and the lower end portion 46*b* is connected to the rear end portion 51*a* of the support block 51 which is disposed slidably in the direction orthogonal to the axis of the through-hole 32 inside the relief hole 36 through the pin 52. In the end portion of the support block 51, the screw body contact portion 51*b*, which is semicircularly formed to accommodate the geometry of the body of the screw S, is provided.

Thus, by the turning motion of the support lever 46 in accordance with the displacement of the pressing element 29, the screw body contact portion 51*b* of the support block 51 is slid through the pin 52 between the position where it is contacted with the body of the screw S in the tightening operation position in the through-hole 32 as shown in FIG. 9 and the position where the screw body contact portion 51*b* is withdrawn to the inside of the relief hole 36.

A support shaft 65 is disposed in the same direction as the axis of the through-hole 32, penetrating through the recess 34 and the recess 35 in the feeder block 30, and by this support shaft 65, one end of the grip finger 55 and that of the grip holder 60 are turnably supported. By a finger spring 56 which is wound around the support shaft 65 in the recess 34, one end being contacted with the wall of the recess 34, and the other end being engaged with a groove 57 provided in the grip finger 55, this grip finger 55 is energized in the direction toward the tightening operation position, and by a holder spring 61 which is wound around the support shaft 65 in the recess 35, one end being contacted with the wall of the recess 35, and the other end being engaged with a groove 62 provided in the grip holder 60, this grip holder 60 is energized in the direction toward the tightening operation position.

Figure 11:
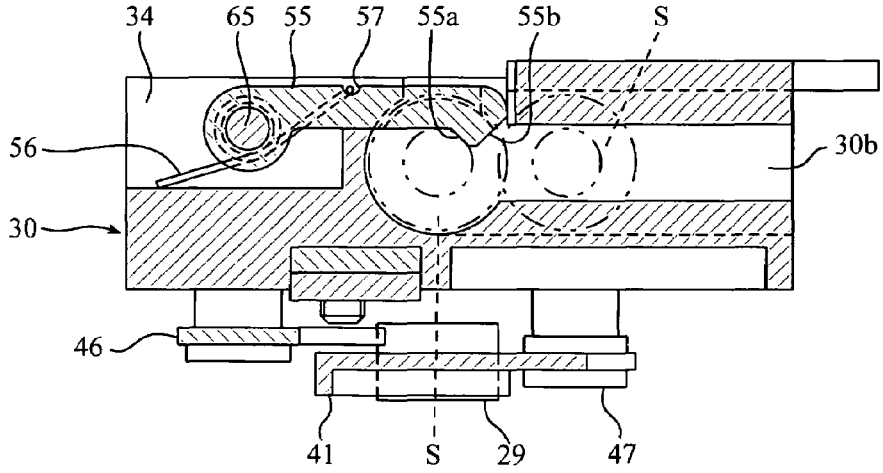
FIG. 11 is an enlarged view illustrating the screws and grip finger in the screw feed mechanism main body of a continuous screw tightening machine according to the present embodiment.

As shown in FIG. 9 and FIG. 11, in the vicinity of the other end of the grip finger 55, the contacting portion 55*a* which is brought into contact with the head or the portion just below it of the screw S in the tightening operation position is provided, and at the other end of the grip finger 55, the screw position regulating portion 55*b* which is contacted with the head of the second screw S following the screw S in the tightening operation position, performing positional regulation, is provided.

Figure 12:
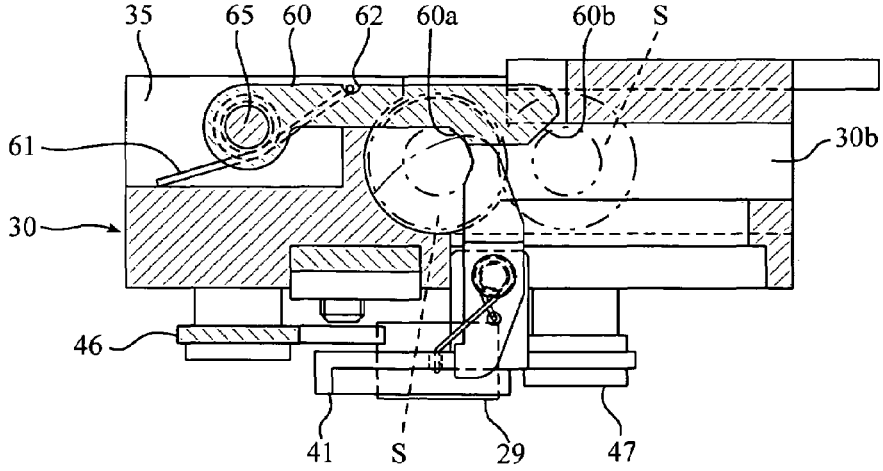
FIG. 12 is an enlarged view illustrating the screws and grip holder in the screw feed mechanism main body of a continuous screw tightening machine according to the present embodiment.

As shown in FIG. 9 and FIG. 12, in the vicinity of the other end of the grip holder 60, the body contacting portion 60*a* which is brought into contact with the body of the screw S in the tightening operation position is provided, and at the other end of the grip holder 60, the screw position regulating portion 60*b* which is contacted with the body of the second screw following the screw S in the tightening operation position, performing positional regulation, is provided.

As shown in FIG. 4 and FIG. 6, on the front side of said feeder block 30, the tip block 12 is mounted by using a set screw 17 (see FIG. 7) which is screwed-in into the feeder block 30.

The tip block 12 has a block main body 14 which is formed such that it encloses the displacement region for the bit 7 protruding passing through the feeder block 30, and a connecting piece 15 which lower end is connected to the block main body 14, and which upper end is attached to the back of the feeder block 30, and by screwing-in the setscrew 17 into the feeder block 30 through an oval hole 18 provided in the connecting piece 15, the tip block 12 is removably and position-adjustably mounted to the screw feed mechanism main body 6.

In other words, with the tip block 12, the protrusion length is capable of being adjusted depending upon the length of the screw S. By loosening the setscrew 17, and adjusting the position of the connecting piece 15 in the range of the oval hole provided along the longitudinal direction of the tip block 12, the tip block is capable of being slid in the direction of the axis of the through-hole 32, and by tightening the setscrew 17, the tip block 12 is capable of being fixed in a desired position with respect to the screw feed mechanism main body 6.

The upper end portion 15*a* of the connecting piece 15 is formed, being folded in the shape of L, and this upper end portion 15*a* is disposed so as to face the upper portion of the through-hole 32 in the feeder block 30. In the upper end portion 15*a*, an insertion hole 15*b* which allows the bit 7 to penetrate without contact, having a bore diameter larger than the outside diameter of the bit 7 is provided.

Next, the stand 80 which is to be mounted to the tip block will be described with reference to FIG. 4 and FIG. 13. As previously described, the stand 80 may be adapted such that it is removably mounted to the tip block 12.

Figure 13:
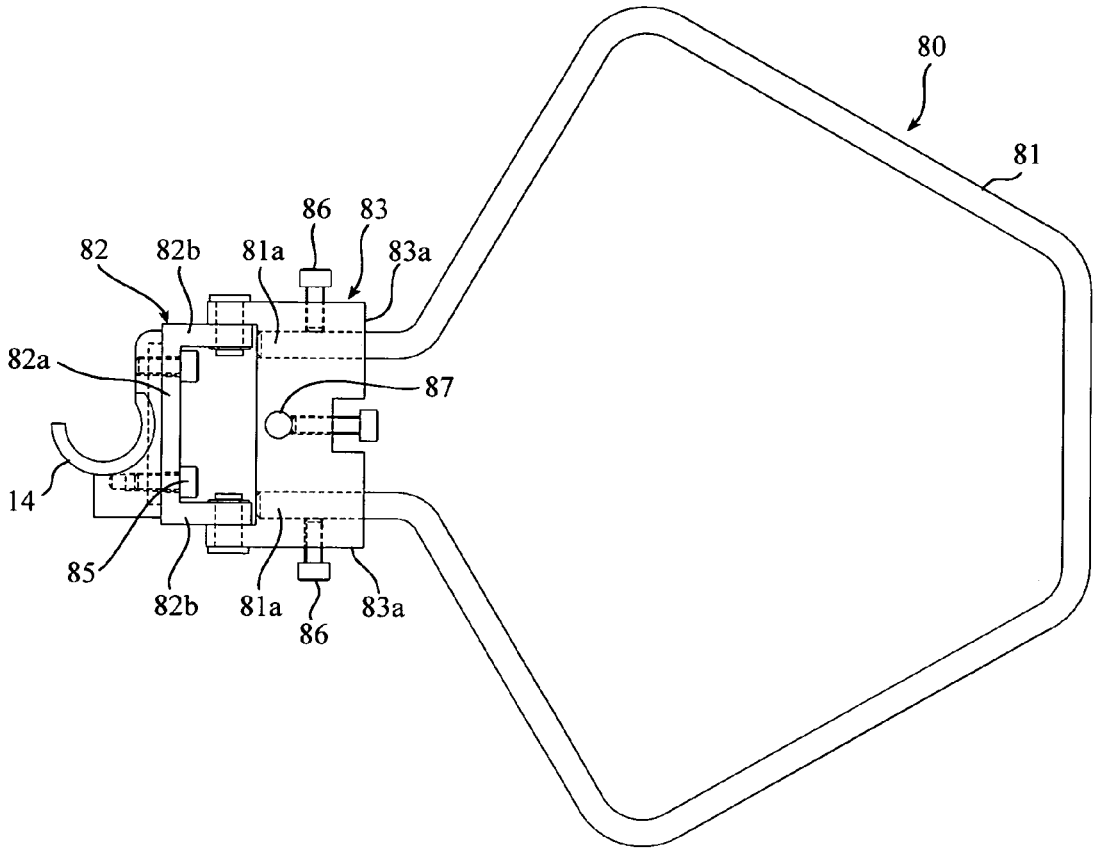
FIG. 13 is a bottom view illustrating the tip block and stand of a continuous screw tightening machine according to the present embodiment.

As shown in FIG. 13, a Π-shaped mounting piece 82*a* of a stand stay 82 of the stand 80 is mounted to the wall of the block main body 14 of the tip block 12 by using bolts 85. Further, to both protrusion pieces 82*b*, 82*b* of the mounting piece 82*a* of the stand stay 82, both side pieces 83*a*, 83*a* of a stand bracket 83 which is approximately a parallelepiped are fixed on the one end side by using screws or the like; into the inside of the both side pieces 83*a*, 83*a* of the stand bracket 83, a pair of protrusion ends 81*a*, 81*a* which are provided for a stand main body 81 formed approximately pentagonally by using a pipe material, for example, are inserted, respectively; and by using bolts 86, the pair of protrusion ends 81*a*, 81*a* are fixed to the both side pieces 83*a*, 83*a*.

In this case, the stand main body 81 is obliquely disposed, being gradually raised upward from the block main body 14 side to the protrusion end side, and by this, the bottom surface of the block main body 14 and the stand main body 81 erect the continuous screw tightening machine 1 in a position slightly inclined from the vertical direction.

From the stand bracket 83 toward the feeder block 30 side, a stand support 87 for stably supporting the stand 80 is protruded, and the upper end portion of this stand support 87 is slidably inserted into the guide portion 37*a* of a feeder cover 37 which is vertically mounted to the back of the feeder block 30 with a definite spacing.

Next, the screw supply mechanism 110 will be described with reference to FIG. 1, FIG. 6, FIG. 5, and FIG. 14 to FIG. 16.

The screw supply mechanism 110 is provided along the tightening machine main body 3, and continuously supplies a number of single-part screws S charged from a screw charge opening 111 in the horizontal orientation while supporting the head and changing the orientation of the screws S by approximately 90 degrees from horizontal to vertical, positioning the head up, during transportation under the force of gravity into a screw receiving opening 70 (see FIG. 5) provided in the screw feed mechanism main body 6.

Figure 14:
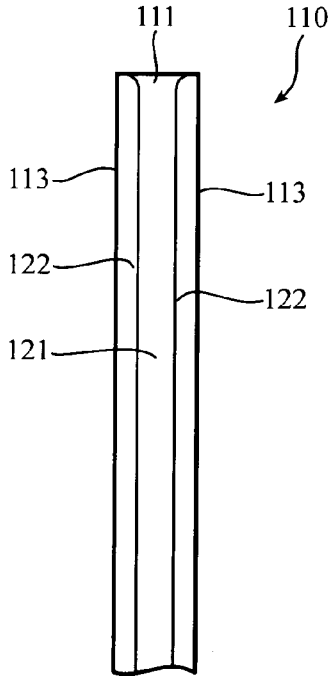
FIG. 14 is a side view illustrating a portion of the screw supply mechanism of a continuous screw tightening machine according to the present embodiment.
Figure 15:
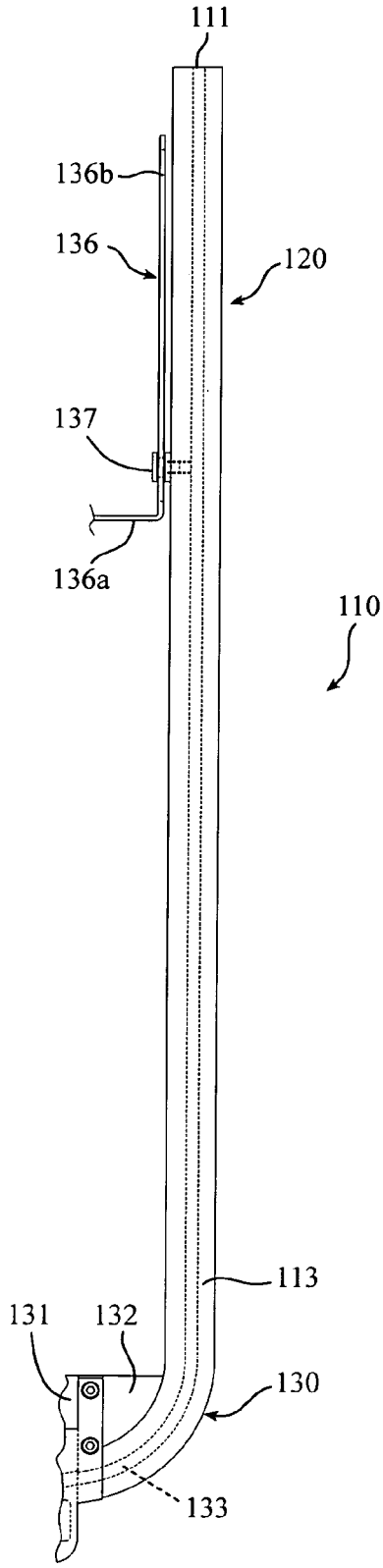
FIG. 15 is a diagrammatic view of the screw supply mechanism of a continuous screw tightening machine according to the present embodiment.
Figure 16:
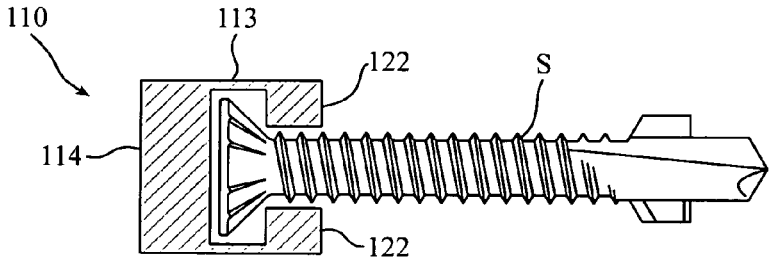
FIG. 16 is a sectional view of the screw supply mechanism of a continuous screw tightening machine according to the present embodiment.
Figure 17:
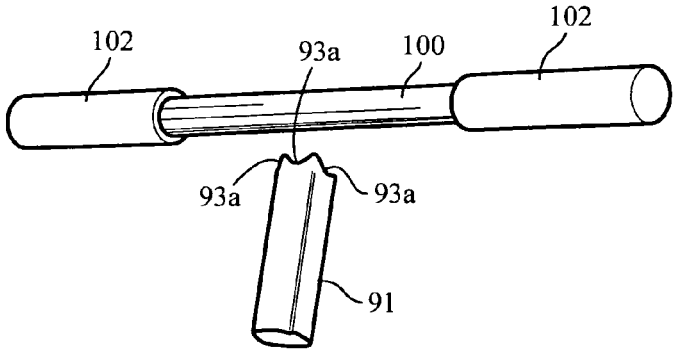
FIG. 17 is a perspective side view illustrating the holding handle of a continuous screw tightening machine according to the present embodiment.
Figure 18:
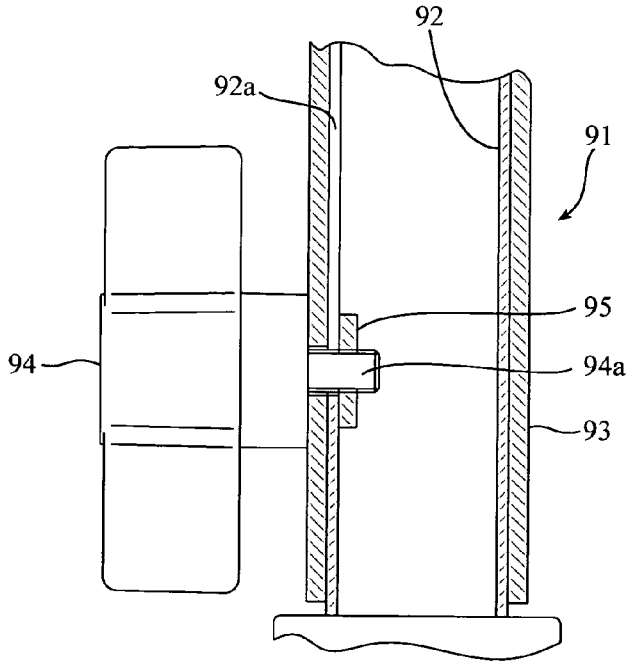
FIG. 18 is a sectional view of a portion of the holding handle of a continuous screw tightening machine according to the present embodiment.

As shown in FIG. 14 to FIG. 16, the screw supply mechanism 110 comprises a straight-line screw feed portion 120 wherein a pair of long and slender chute plates 113 running from the screw charge opening 111 occupying a position in the vicinity of the grip handle 2 in the tightening machine main body 3 to near the feeder block 30 are disposed, being opposed to each other, sandwiching a chute spacer 114; a screw-S head accommodating space 121 (see FIG. 16) is formed inside along the longitudinal direction; and a screw body insertion opening 122 having a clearance slightly larger than the diameter of the body of the screw S is formed along the longitudinal direction on the end side opposite to the chute spacer 114 between the pair of chute plates 113.

The chute plate 113 is provided with number-of-pieces indicating portions 123 which indicate the number of screws S (such as 20 or 30) accommodated inside the screw supply mechanism 110.

The screw supply mechanism 110 comprises a circular arc-shaped screw supply portion 130 one end of which connects to the straight-line screw feed portion 120 and the other end of which connects to the screw feed mechanism main body 6.

The circular arc-shaped screw supply portion 130 is configured such that, with a chute bracket 132 being screw-fixed to a feeder bracket screw-fixed to the feeder block 30, the screw S dropping from the straight-line screw feed portion 120 through a gravity type supply path 133 which is formed in the chute bracket 132, being provided with a shape corresponding to the screw-S head accommodating space 121 and screw body insertion opening 122, and being curved in a circular arc shape is supplied into the screw receiving opening 70 provided in the screw feed mechanism 6.

Figure 5:
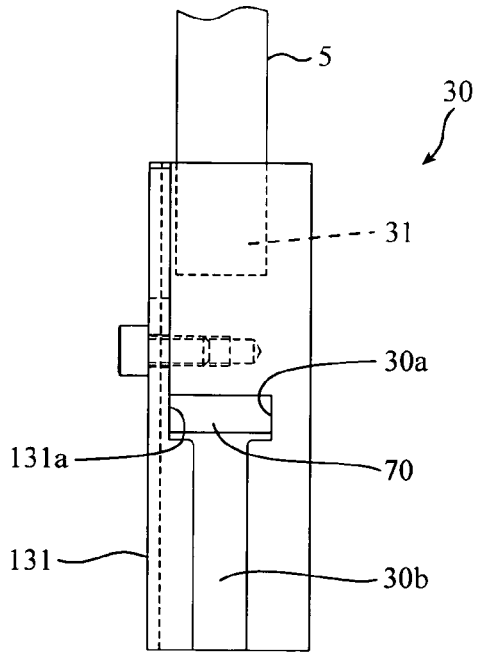
FIG. 5 is a diagrammatic side view of the screw feed mechanism main body of a continuous screw tightening machine according to the present embodiment.

As shown in FIG. 5 and FIG. 9, in the feeder block 30 and the feeder bracket 131 which is screw-fixed to this feeder block 30, head grooves 30*a*, 131*a* for receiving the head of the screw S are formed inward from the screw receiving opening 70, and between the feeder block 30 and the feeder bracket 131, a clearance 30*b* running to the tightening operation position through which the body of the screw S is capable of being passed is formed.

Figure 2:
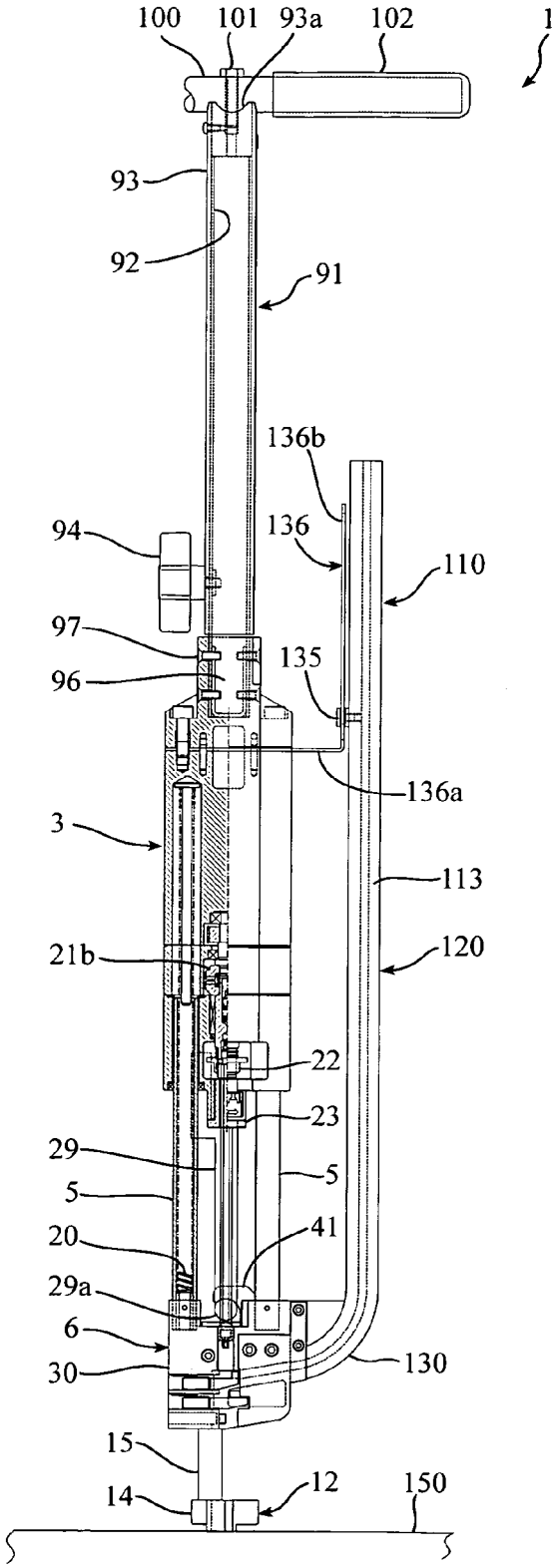
FIG. 2 is a diagrammatic view, with portions broken away for the sake of clarity, of a continuous screw tightening machine according to the present embodiment.
Figure 3:
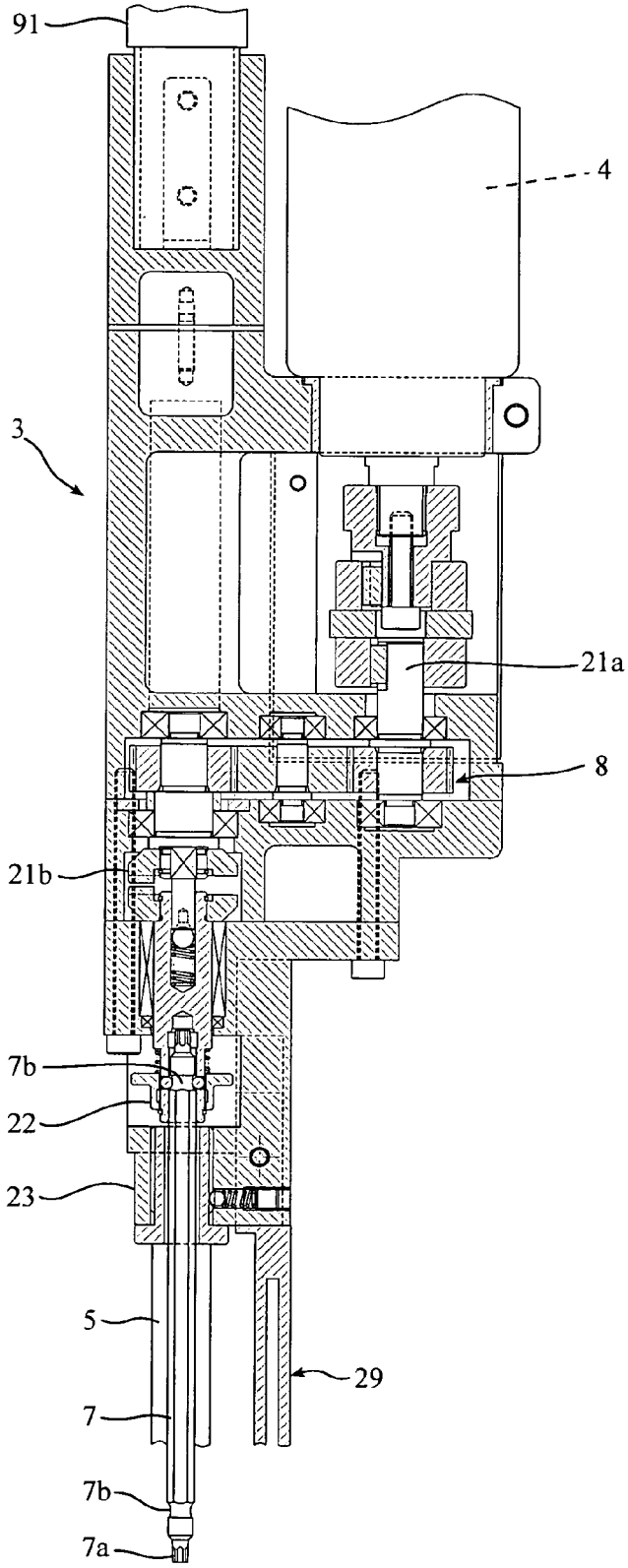
FIG. 3 is a diagrammatic sectional view of the tightening machine main body of a continuous screw tightening machine according to the present embodiment.

As shown in FIG. 2, a chute stay 136 is attached to the chute spacer 114 in the straight-line screw feed portion 120. The chute stay 136 is folded in the shape of L as shown in FIG. 2; the horizontal piece portion 136*a* is mounted to the tightening machine main body 3; the vertical piece portion 136*b* is disposed along the outside vicinity of the straight-line screw feed portion 120; a screw 137 is inserted into the oval hole portion in the vertical piece portion 136*b* that is provided along the longitudinal direction of the straight-line screw feed portion 120 to be screwed-in into the chute spacer 114; and by this, the tightening machine main body 3 and the straight-line screw feed portion 120 are capable of being relatively slid. Thus, the movement of the tightening machine main body 3 in the longitudinal direction with respect to the screw feed mechanism main body 6 being capable of carried out with no obstacle.

Next, the holding handle 90 will be described with reference to FIG. 1, FIG. 2, FIG. 17, and FIG. 18.

The handle 90 comprises an arm 91 which end portion is removably fixed by tightening screws 97 to a recess 96 formed in the back of the tightening machine main body 3 of the continuous screw tightening machine 1, and a bar 100 which central portion is removably mounted to this arm 91 by using a screw 101. To the circumference at both ends of the bar 100, two holding portions 102, 102 made of a foamed plastic material, for example, are mounted.

With the arm 91, an inner pipe member 92 and an outer pipe member 93, which are different in diameter, are concentrically disposed, and slidably fitted; the end portion of the inner pipe member 92 is removably mounted to the recess 96 by means of the screws 97; and the back end of the outer pipe member 93 is removably mounted to the central portion of the bar 100 by using the screw 101.

Thus, the bolt portion 94*a* is inserted into a vertical groove-like oval hole 92*a* formed in the inner wall of the inner pipe member 92 from the outside of the outer pipe member 93, and inside of the inner pipe member 92, a nut 95 and the bolt portion 94*a* are engaged with each other. Therefore, by loosening an adjusting screw 94 screwed-in into the inner pipe member 92 from the outside of the outer pipe member 93; adjusting the length of protrusion of the outer pipe member 93 from the inner pipe member 92; and tightening the adjusting screw 94, the length of protrusion of the arm 91 from the tightening machine main body 3 is capable of being freely adjusted.

In the back end portion of the outer pipe member 93, four-in-total approximately semicircular cutout concave portions 93*a* are formed, being equally spaced on the circumference of the outer pipe member 93. By resting the bar 100 on two opposed cutout concave portions 93*a* of the back end portion of the outer pipe member 93, and screwing-in the screw 101, a first mounting position is taken, and by resting the bar 100 on the two opposed cutout concave portions 93*a* of the back end portion of the outer pipe member 93 that are different in angular position by 90 degrees from the above-mentioned two opposed cutout concave portions 93*a*, and screwing-in the screw 101, a second mounting position is taken. Thus, the mounting position of the bar 100 with respect to the arm 91 is capable of being adjusted between two 90 degree different orientations.

When the continuous screw tightening machine 1 of the present embodiment that is equipped with such a handle 90 is used with an object 150 (see FIG. 2), such as the floor of the load-carrying platform of a cargo truck, the operator can perform his work, gripping the holding portions 102, 102 in the erect position, and by adjusting the length of protrusion of the arm 91, the operability best suited for the physical constitution and stature of the operator is capable of being obtained.

Next, the way of operating the continuous screw tightening machine 1 of the present embodiment will be described with reference to FIG. 19 and FIG. 20. As an example of the way of operating the continuous screw tightening machine 1, FIG. 19 illustrates the operation in which the screw S in the tightening operation position in the screw feed mechanism main body 6 is screwed-in into the object 150 by means of the bit 7 with a stroke of 76 mm for the bit 7, and then, the bit 7 is returned to the initial position.

It is assumed that a number of single-part screws S charged in the horizontal orientation from the screw charge opening 111 in said the screw supply mechanism 110 are being supplied into the screw receiving opening 70 provided in the screw feed mechanism main body 6 with the head up, the orientation of the screws S being changed by approximately 90 degrees from horizontal to vertical during transportation under the force of gravity.

Figure 19:
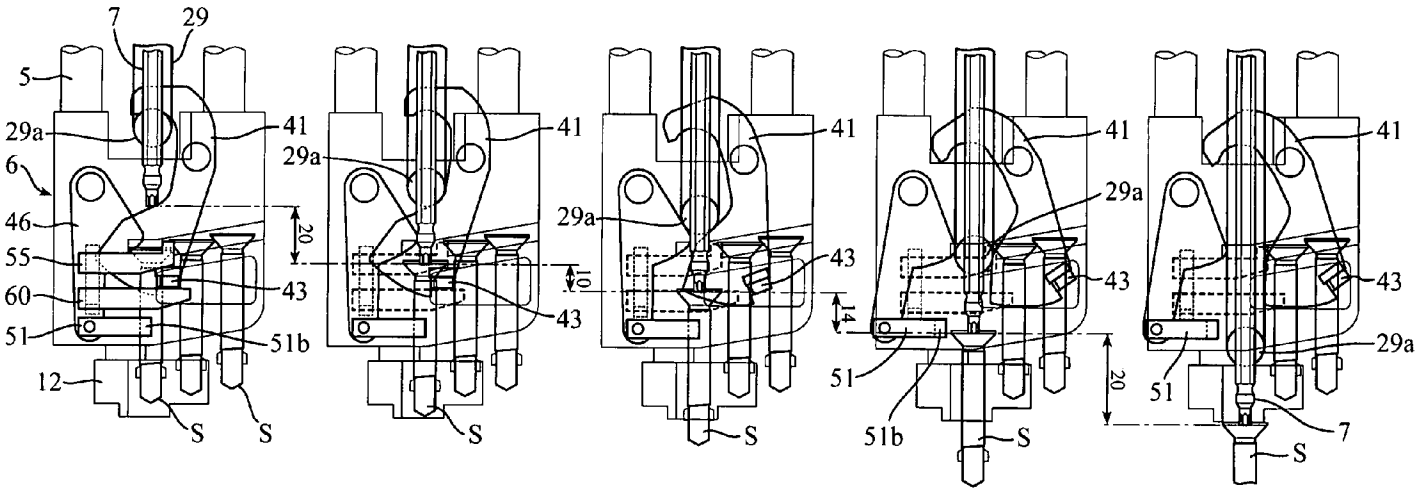
FIG. 19 is an explanatory drawing of the operations of the bit, the pressing element, and each element of the screw feed mechanism main body in screwing-in operation of a continuous screw tightening machine according to the present embodiment.

In the initial position as shown in FIG. 19 (*a*), the bit 7 in the tightening machine main body 3 is positioned 20 mm backward (upward), and at this time, the end portion 29*a* of the pressing element 29 is engaged with the contoured portion 41*a* of the feed lever 41, the feed lever 41 being maintained in the initial position. At this time, the feed latch 43 presses the body just under the head of the screw S in the tightening operation position toward the center of the through-hole 32 by the energizing force of the energizing spring 42*a* acting on the feed lever 41.

The end portion 29*a* of the pressing element 29 is not in contact with the support lever 46, which is energized in a counterclockwise direction by the energizing force of the energizing spring 47*a* in FIG. 19. By this, the support block 51 in the relief hole 36 is pressed toward the center of the through-hole 32 through the pin 52, and the screw body contact portion 51*b* is contacted with the circumference of the body of the screw S under the feed latch 43, holding the body of the screw S in the prescribed position.

Further, the contacting portion 55*a* of the grip finger 55 presses the head or its vicinity of the screw S toward the center of the through-hole 32 by the energizing force of the finger spring 56, and the body contacting portion 60*a* of the grip holder 60 presses the body of the screw S toward the center of the through-hole 32 by the energizing force of the holder spring 61. The direction of pressing the screw S by the grip finger 55 and the grip holder 60 is different by 90 degrees from that of pressing the screw S by the feed latch 43.

The screw position regulating portion 55*b* of the grip finger 55 is contacted with the head of the screw S following the screw S in the tightening operation position, performing positional regulation such that the head of the screw S in the tightening operation position is prevented from contacting with the head of the following screw S. The screw position regulating portion 60*b* of the grip holder 60 is contacted with the body of the screw S following the screw S in the tightening operation position, performing positional regulation such that the body of the screw S in the tightening operation position is prevented from contacting with the body of the following screw S.

In such a condition, the operator grips the holding portions 102; places (or brings) the bottom surface of the tip block 12 in the continuous screw tightening machine 1 into contact with the object 150, such as the floor of the load-carrying platform of a cargo truck; turns ON the trigger switch 2*a* of the grip handle 2 by the index finger to start the driving machine 4 in the tightening machine main body 3. By the rotation of the driving machine 4, the rotating spindle 21*a*, the reduction gear 8, and the driving machine side of the clutch 21*b* are brought into the rotation state.

The turning-ON operation of the trigger switch 2*a* is capable of being locked by means of a lock button 2*b* provided on the side surface of the grip handle.

Further, when the tightening machine main body 3 is pushed 20 mm forward (see FIG. 19 (*b*)), the engaging convex 7*a* of the bit 7 connected to the lower portion of the clutch 21*b* is engaged with the screw S, the bit side of the clutch 21*b* being pushed up, and the clutches 21*b* are engaged, resulting in the bit 7 connected to the lower portion of the clutch 21*b* being rotated. By this, the screwing-in operation into the object 150 of the screw S is started.

In this state, the end portion 29*a* of the pressing element 29 starts contacting with the lower contoured portion 41*b* of the feed lever 41.

The support lever 46 remains in the initial state.

When the operator pushes the tightening machine main body 3 further 10 mm forward (see FIG. 19 (*c*)), the tip of the screw S is screwed-in into the object 150 by 10 mm by the rotation of the bit 7. At this time, the end portion 29*a* of the pressing element 29 presses the lower contoured portion 41*b* of the feed lever 41 to turn the feed lever 41 in a counterclockwise direction in FIG. 19 (*c*), and by this, the feed latch 43 is withdrawn from the screw S which is being screwed-in inside the latch hole 33.

The head of the screw S is moved forward by 10 mm, while pushing the contacting portion 55*a* of the grip finger 55 outward, to leave the contacting portion 55*a* of the grip finger 55, being brought into the state in which it pushes the body contacting portion 60*a* of the grip holder 60. At this time, the grip finger 55 is returned to the initial state, the screw position regulating portion 55*b* performing positional regulation of the head of the following screw S.

The end portion 29*a* of the pressing element 29 is brought into the state in which it is contacted with the contoured portion 46*a* of the support lever 46, the support lever 46 starting turning, and the screw body contact portion 51*b* of the support block 51 starts being withdrawn from the initial position.

Then, when the operator pushes the tightening machine main body 3 further 14 mm forward (see FIG. 19 (*d*)), the tip of the screw S is screwed-in into the object 150 by 14 mm by the rotation of the bit 7. At this time, the end portion 29*a* of the pressing element 29 further turns the lower contoured portion 41*b* of the feed lever 41 in a counterclockwise direction in FIG. 19 (*e*), and the feed latch 43 is displaced to the maximum withdrawal position inside the latch hole 33.

With the tightening machine main body 3 being pushed forward, the end portion 29*a* of the pressing element 29 turns the contoured portion 46*a* of the support lever 46 in a clockwise direction, and by this, the support block 51 is withdrawn, through the pin 52, to the position where it is hidden inside the relief hole 36.

Therefore, the head of the screw S which is being screwed-in will not interfere with the screw body contact portion 51*b* of the support block 51. In addition, with the tightening machine main body 3 being pushed forward, the screw S comes off from the body contacting portion 60*a* of the grip holder 60, the grip holder 60 being returned to the initial position.

When the operator pushes the tightening machine main body 3 further 32 mm (for a stroke of 76 mm) forward (see FIG. 19 (*e*)), screwing-in of the screw S into the object 150 by the rotation of the bit 7 is terminated.

At this time, the upper end portion 15*a* of the connecting piece 15 for the tip block 12 is brought into contact with the adjuster ring 23, the clutch 21*b* being disengaged, and the bit 7 being stopped.

In this state, both sides of the pressing element 29 in place of the end portion 29*a* of the pressing element 29 are in contact with the lower contoured portion 41*b* of the feed lever 41 and the contoured portion 46*a* of the support lever 46; the feed latch 43 is kept in the maximum withdrawal position inside the latch hole 33; and the support block 51 is kept in the position where it is hidden inside the relief hole 36. The screw position regulating portion 55*b* of the grip finger 55 performs positional regulation of the head of the following screw S, and the screw position regulating portion 60*b* of the grip holder 60 performs positional regulation of the body of the following screw S.

Thus, one screw S in the tightening operation position is capable of being screwed-in into the object 150 by the 76-mm stroke forward operation of the tightening machine main body 3.

Next, when the operator releases the forward pushing force of the tightening machine main body 3, the tightening machine main body 3 is returned backward, i.e., in the direction opposite to the above-mentioned pushing direction by the elastic force of said elastic member 20, and the status of the bit 7, the pressing element 29, and the screw feed mechanism 24 of the screw feed mechanism main body 6 is changed from the respective screwing-in completion statuses (see FIG. 19 (*e*)) to the stroke-O-mm status as shown in FIG. 19 (*h*), which is the same as the status as shown in FIG. 19 (*a*), through the stroke-30-mm status as shown in FIG. 19 (*f*), and the stroke-8-mm status as shown in FIG. 19 (*g*). When the bit 7 of the tightening machine main body 3 is returned to the position of stroke 30 mm from that of stroke 76 mm, the end portion 29*a* of the pressing element 29 is also returned in synchronism, the feed lever 41 being turned in a clockwise direction in FIG. 19 (*f*) with the end portion 29*a* of the pressing element 29 being brought into contact with the lower contoured portion 41*b* of the feed lever 41, and the engaging concave 43*b* of the feed latch 43 being brought into a position where the second screw S is being supplied to the tightening operation position.

The support lever 46 is turned in a counterclockwise direction in FIG. 19 (*f*) with the end portion 29*a* of the pressing element 29 being brought into contact with the contoured portion 46*a* of the support lever 46, and the screw body contact portion 51*b* of the support block 51 being slid in the relief hole 36 with the turning of the support lever 46 to be brought into the initial position, i.e., the position as shown in FIG. 19 (*a*).

At the stage during which the bit 7 of the tightening machine main body 3 is returned from the stroke-30-mm position to stroke-8-mm position, the end portion 29*a* of the pressing element 29 is separated from the lower contoured portion 41*b* and starts contacting with the contoured portion 41*a* of the feed lever 41. In synchronism with such operations of the end portion 29*a* of the pressing element 29 and the feed lever 41, the engaging concave 43*b* of the feed latch 43 mounted to the feed lever 41 is brought into the state in which the following, i.e., second screw S has been carried just before the tightening operation position (FIG. 19 (*g*)).

In this state, the contoured portion 41*a* of the feed lever 41 is stopped, the elasticity of the energizing spring 42*a* applying a force in the direction reverse to the pushing direction to the pressing element 29. At the same time, the tightening machine main body 3 and the screw feed mechanism main body 6 are subjected to an elastic force by the elastic member 20 in the direction in which they are separated from each other, thus the end portion 29*a* of the pressing element 29 turns the feed lever 41 in a clockwise direction in FIG. 19 (*g*) through the contact with the contoured portion 41*a*, returning it to the initial state as shown in FIG. 19 (*h*).

By the turning of the feed lever 41 at this time, the engaging concave 43*b* of the feed latch 43 feeds the following screw S into the tightening operation position.

In feeding the screw S into the tightening operation position, the head of the screw S once turns the grip finger 55 outward, but the finger spring 56 returns the grip finger 55, the screw position regulating portion 55*b* performing positional regulation of the head of the following screw S. Similarly, in feeding the screw S into the tightening operation position, the body of the screw S once turns the grip holder 60 outward, but the holder spring 61 returns the grip holder 60, the screw position regulating portion 60*b* performing positional regulation of the head of the following screw S. By this, the interference of the screw S fed in the tightening operation position with the screw S following it is capable of being avoided.

Figure 20:
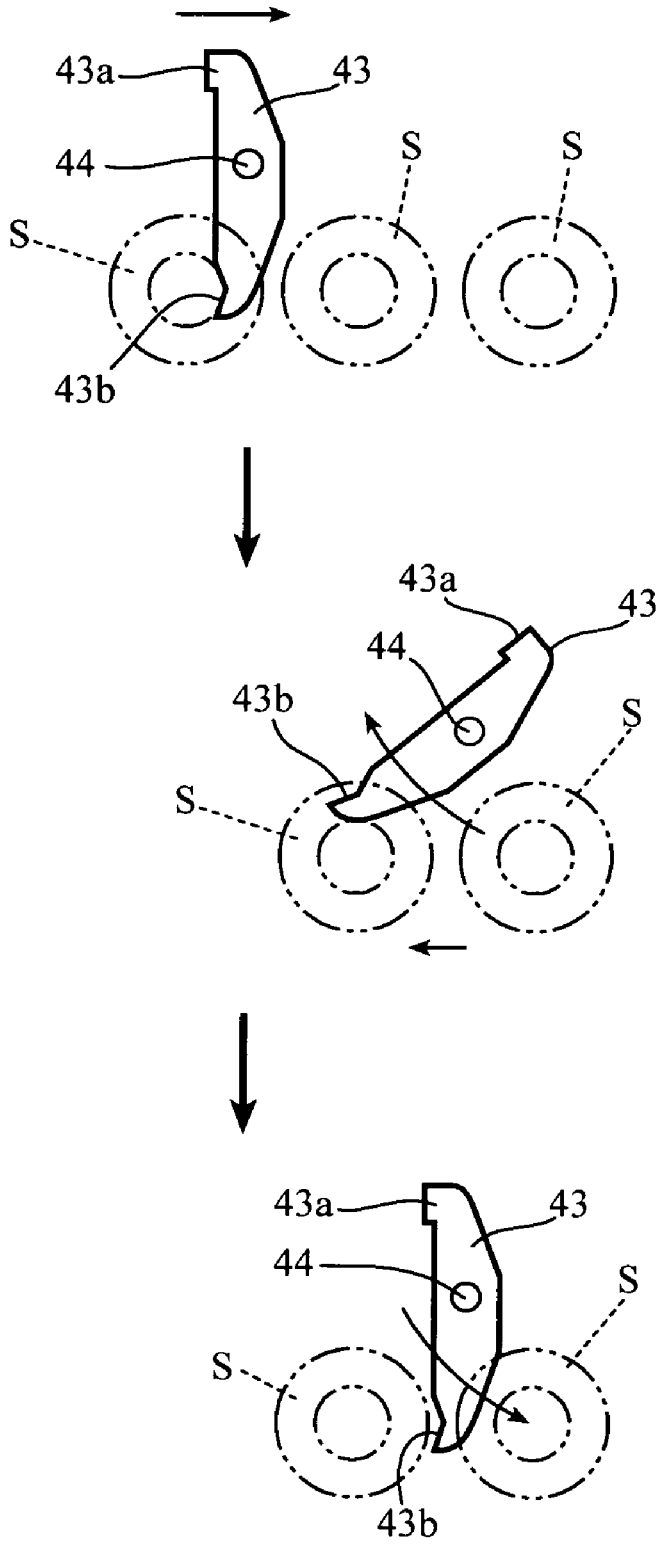
FIG. 20 is an explanatory drawing of the operations of the feed latch of a continuous screw tightening machine according to the present embodiment in withdrawal and screw supplying.

FIG. 20 illustrates the operation of the feed latch 43 mounted to the feed lever 41 when it is withdrawn from the tightening operation position, and the operation when the screw S is supplied to the tightening operation position.

When the feed latch 43 mounted to the feed lever 41 is withdrawn from the tightening operation position toward the side inside the latch hole 33 with the turning of the feed lever 41, the feed latch 43 is hit against the body of the screw S following the screw S in the tightening operation position. At this time, as shown in FIG. 20, the feed latch 43 is energized by the spring 45 (see FIG. 10) such that the one end 43*a* is contacted with the feed lever 41, thus when the engaging concave 43*b* of the feed latch 43 is hit against the screw S, it is turned around the pin 44 against the energizing force of the spring 45 to escape from this screw S, and then moved toward the outside of the latch hole 33 to be returned to the original state by the spring 45, occupying the position between the screw S and the following screw S.

When the screw S is supplied to the tightening operation position, the engaging concave 43*b* of the feed latch 43 that occupies the position between the screw S and the following screw S is contacted with the body of the screw S, supplying the screw S to the tightening operation position in synchronism with the turning of the feed lever 41.

Hereafter, by the operation similar to that as described above, a number of screws S are capable of being continuously screwed-in into the object 150.

The present invention can be widely applied to operation of screwing-in of screws into such structural members as the floor of the load-carrying platform of a cargo truck, and the floor of a building, house, and vessel, and according to the present invention, a continuous screw tightening machine with which, by appropriately changing the dimensions of the elements of the continuous screw tightening machine itself, screws widely different in size can be handled is obtainable.

What is claimed is:

1. A continuous screw tightening machine comprising:

a driving machine, equipped with a grip handle, is mounted to said driving machine;

a bit for screw tightening, said bit being removably connected to the driving machine through a reduction gear and a clutch to configure a tightening machine main body;

a screw feed mechanism main body mounted to a front of said tightening machine main body such that said screw feed mechanism main body is capable of being slid in a longitudinal direction of said bit relative to said tightening machine main body, wherein said bit is rotatably inserted inside of said screw feed mechanism main body;

a screw feed mechanism configured in said screw feed mechanism main body, said screw feed mechanism being synchronized with the sliding in the longitudinal direction of said tightening machine main body involved in a screw tightening operation by the bit to sequentially feed a screw to a position where a tightening operation is being carried out by the bit, wherein said screw feed mechanism comprises a feeder block having a through hole through which the bit can be passed, a feed lever mounted to the back of said feeder block, and a support lever mounted to the back of said feeder block, wherein said feeder block includes a recess receiving a grip finger for holding a head of a screw, a recess receiving a grip holder for holding the head of the screw, and a relief receiving a support block that is movable in a transverse direction relative to the longitudinal axis of the bit, said feeder block also being provided with a latch hole forming a displacement space for a feed latch which is mounted to the feed lever;

a screw supply mechanism for continuously supplying a number of single-part screws in sequence under the force of gravity to said screw feed mechanism, said screw supply mechanism being fixed to said screw feed mechanism main body so that an outlet end of said screw supply mechanism is positioned at a screw receiving opening in said screw feed mechanism to directly deliver screw to the screw feed mechanism; and a tip block connected to said screw feed mechanism main body, said tip block providing a surface to be contacted with an object, wherein a desired position of said tip block, in the longitudinal direction with respect to the screw feed mechanism main body, is adjustable.

2. A continuous screw tightening machine as claimed in claim 1, wherein an upper portion of said screw supply mechanism is connected to said tightening machine main body such that the screw supply mechanism is movable relative to said tightening machine main body.

3. A continuous screw tightening machine as claimed in claim 1, wherein said feed latch includes an engaging concave portion provided at one end for receiving the body of the screw, and the engaging concave portion is reciprocally moved by a turning motion of the feed lever in accordance with displacement of said pressing element.

4. A continuous screw tightening machine comprising:

a driving machine equipped with a grip handle;

a bit for screw tightening, said bit being removably connected to said driving machine through a reduction gear and a clutch to configure a tightening machine main body;

a screw feed mechanism main body mounted to the front of said tightening machine main body such that said screw feed mechanism main body is capable of being slid in a longitudinal direction of said bit relative to said tightening machine main body, wherein said bit is rotatably inserted inside of said screw feed mechanism main body;

a screw feed mechanism configured in said screw feed mechanism main body, said screw feed mechanism being synchronized with the sliding in the longitudinal direction of the tightening machine main body in a screw tightening operation to sequentially feed a screw to a position where the tightening operation is carried out by the bit, wherein said screw feed mechanism comprises a feeder block having a through hole through which the bit can be passed, a feed lever mounted to the back of said feeder block, and a support lever mounted to the back of said feeder block, wherein said feeder block includes a recess receiving a grip finger for holding a head of a screw, a recess receiving a grip holder for holding the head of the screw, and a relief receiving a support block that is movable in a transverse direction relative to the longitudinal axis of the bit, said feeder block also being provided with a latch hole forming a displacement space for a feed latch that is mounted to the feed lever;

a screw supply mechanism for continuously supplying a number of single-part screws in sequence under the force of gravity to the screw feed mechanism, said screw supply mechanism being connected to said screw feed mechanism main body so as to be movable relative to said tightening machine main body;

a tip block connected to said screw feed mechanism main body, and providing a surface to be contacted with an object, said tip block being configured such that said tip block is capable of being selectively fixed in a desired position in the longitudinal direction with respect to the screw feed mechanism main body; and a stand mounted through said tip block and being capable of being movably fixed in the longitudinal direction, said stand being operable to support said screw tightening machine in an upright position.

5. A continuous screw tightening machine as claimed in claim 4, wherein an upper portion of said screw supply mechanism is connected to said tightening machine main body such that the screw supply mechanism is movable relative to said tightening machine main body.

6. A continuous screw tightening machine as claimed in claim 4, wherein said feed latch includes an engaging concave portion provided at one end for receiving the body of the screw, and the engaging concave portion is reciprocally moved by a turning motion of the feed lever in accordance with displacement of said pressing element.

7. A continuous screw tightening machine as claimed in claim 4, wherein said stand projects at an angle with respect to a supporting surface when said tip block contacts the surface and the bit is oriented in vertical position.

8. A continuous screw tightening machine comprising:

a driving machine equipped with a grip handle;

a bit for screw tightening, said bit being removably connected to said driving mechanism through a reduction gear and a clutch to configure a tightening machine main body;

a pressing element disposed with a fixed spacing from said bit and being protruded in the same direction as said bit;

a holding handle adjustably and removably mounted to said tightening machine main body;

a screw feed mechanism main body mounted to the front of said tightening machine main body such that said screw feed mechanism main body is capable of being slid in a longitudinal direction of said bit relative to said tightening machine main body, wherein said bit is rotatably inserted inside of said screw feed mechanism main body, and said pressing element is disposed so as to face the inside of said screw feed mechanism main body;

a screw feed mechanism which, in response to displacement of said pressing element by the sliding of said tightening machine main body in a backward direction after the completion of the tightening operation by the bit in said screw feed mechanism main body, is operable to sequentially feed a single-piece screw to a position for performing a tightening operation by said bit, while performing positional regulation of a following single-piece screw to position and hold the head and body of the screw, and, in response to displacement of said pressing element by the sliding of said tightening machine main body in a forward direction in a tightening operation, said screw feed mechanism releases the positioning and holding of the head and body of the screw, wherein said screw feed mechanism comprises a feeder block having a through hole through which the bit can be passed, a feed lever mounted to the back of said feeder block, and a support lever mounted to the back of said feeder block, wherein said feeder block includes a recess receiving a grip finger for holding a head of a screw, a recess receiving a grip holder for holding the head of the screw, and a relief receiving a support block that is movable in a transverse direction relative to the longitudinal axis of the bit, said feeder block also being provided with a latch hole forming a displacement space for a feed latch which is mounted to the feed lever;

a screw supply mechanism provided along said tightening machine main body for continuously and sequentially supplying a number of the single-part screws charged from a screw charge opening in a horizontal orientation while supporting the head and changing the orientation of the screws from the horizontal orientation to a vertical orientation during transportation under the force of gravity into a screw receiving opening provided in the screw feed mechanism main body;

a tip block connected to said screw feed mechanism main body and providing a surface to be contacted with an object, said tip block being selectively fixed in a desired position in the longitudinal direction with respect to the screw feed mechanism main body; and a stand mounted through said tip block and being capable of being movably fixed in the longitudinal direction, said stand being operable to support said screw tightening machine in an upright position.

9. A continuous screw tightening machine as claimed in claim 8, wherein an upper portion of said screw supply mechanism is connected to said tightening machine main body such that the screw supply mechanism is movable relative to said tightening machine main body.

10. A continuous screw tightening machine as claimed in claim 8, wherein said feed lever and said support lever turn in response to displacement of said pressing portion in the longitudinal direction.

11. A continuous screw tightening machine as claimed in claim 8, wherein said stand projects at an angle with respect to a supporting surface when said tip block contacts the surface and the bit is oriented in vertical position.

12. A continuous screw tightening machine comprising:

a driving machine equipped with a grip handle;

a bit for screw tightening removably connected to said driving machine through a reduction gear and a clutch to configure a tightening machine main body;

a screwing-in depth adjusting mechanism for adjusting the screwing-in depth for said bit;

a pressing element disposed with a fixed spacing from said bit, said pressing element protruding in the same direction as said bit;

a holding handle adjustably and removably mounted to the tightening machine main body;

a screw feed mechanism main body mounted to a front of said tightening machine main body such that said screw feed mechanism main body is capable of being slid in a longitudinal direction of said bit relative to said tightening machine main body, wherein said bit is rotatably inserted into said screw feed mechanism main body, and said pressing element is disposed so as to face the inside of said screw feed mechanism main body;

a screw feed mechanism which, in response to displacement of said pressing element by the sliding of said tightening machine main body in a backward direction after the completion of the tightening operation by the bit in said screw feed mechanism main body, is operable to sequentially feed a single-piece screw to a position for performing a tightening operation by said bit, while performing positional regulation of a following single-piece screw to position and hold the head and body of the screw, and, in response to displacement of said pressing element by the sliding of said tightening machine main body in a forward direction in a tightening operation, said screw feed mechanism releases the positioning and holding of the head and body of the screw, wherein said screw feed mechanism comprises a feeder block having a through hole through which the bit can be passed, a feed lever mounted to the back of said feeder block, and a support lever mounted to the back of said feeder block, wherein said feeder block includes a recess receiving a grip finger for holding a head of a screw, a recess receiving a grip holder for holding the head of the screw, and a relief receiving a support block that is movable in a transverse direction relative to the longitudinal axis of the bit, said feeder block also being provided with a latch hole forming a displacement space for a feed latch which is mounted to the feed lever;

a screw supply mechanism provided along said tightening machine main body, said screw supply mechanism being operable to continuously and sequentially supply a number of single-part screws charged from a screw charge opening in a horizontal orientation while supporting the head and changing the orientation of the screws from the horizontal orientation to a vertical orientation during transportation under the force of gravity into a screw receiving opening provided in said screw feed mechanism main body;

a tip block connected to said screw feed mechanism main body and providing a surface to be contacted with an object, said tip block being selectively fixed in a desired position in the longitudinal direction with respect to the screw feed mechanism main body, and a stand for supporting said continuous screw tightening machine in an upright position, said stand being mounted through said tip block and being movably fixed in the longitudinal direction.

13. A continuous screw tightening machine as claimed in claim 12, wherein an upper portion of said screw supply mechanism is connected to said tightening machine main body such that the screw supply mechanism is movable relative to said tightening machine main body.

14. A continuous screw tightening machine as claimed in claim 12, wherein said screw feed mechanism comprises a feeder block, a feed lever mounted to the back of said feeder block, and a support lever mounted to the back of said feeder block, wherein said feed lever and said support lever turn in response to displacement of said pressing portion in the longitudinal direction.

15. A continuous screw tightening machine as claimed in claim 12, wherein said stand projects at an angle with respect to a supporting surface when said tip block contacts the surface and the bit is oriented in vertical position.

* * * * *